US010905223B2

(12) United States Patent
Karl, IV et al.

(10) Patent No.: US 10,905,223 B2
(45) Date of Patent: Feb. 2, 2021

(54) HYDRATION BLADDER INCLUDING LIQUID MOVEMENT REDUCING FEATURES

(71) Applicant: Shock Doctor, Inc., Fountain Valley, CA (US)

(72) Inventors: Adam Peter Karl, IV, Burlington, VT (US); Benjamin Casey Lanza, Sheldon, VT (US); James Creath Frazier, Hinesburg, VT (US); Bradley Philip Fishkin, Burlington, VT (US); Faith LeAnn Piotrowski, Warminster, PA (US)

(73) Assignee: Shock Doctor, Inc., Fountain Valley, CA (US)

( * ) Notice: Subject to any disclaimer, the term of this patent is extended or adjusted under 35 U.S.C. 154(b) by 70 days.

(21) Appl. No.: 16/207,552

(22) Filed: Dec. 3, 2018

(65) Prior Publication Data

US 2019/0098990 A1 Apr. 4, 2019

Related U.S. Application Data

(63) Continuation of application No. PCT/US2016/035784, filed on Jun. 3, 2016.

(51) Int. Cl.
*A45F 3/20* (2006.01)
*A45F 3/16* (2006.01)

(52) U.S. Cl.
CPC ..... *A45F 3/20* (2013.01); *A45F 2003/166* (2013.01)

(58) Field of Classification Search
CPC ..... A45F 3/20; A45F 2003/166; A45F 3/18
See application file for complete search history.

(56) References Cited

U.S. PATENT DOCUMENTS

| | | | |
|---|---|---|---|
| D185,649 | S | 7/1959 | Schlumbohm |
| 3,426,940 | A | 2/1969 | Broerman |
| D249,111 | S | 8/1978 | Geyer |
| 4,703,863 | A | 11/1987 | Kohus |
| D295,259 | S | 4/1988 | Goettner |
| D312,878 | S | 12/1990 | Mariol |
| D313,075 | S | 12/1990 | Mariol |
| D350,672 | S | 9/1994 | Egger et al. |
| 5,609,039 | A | 3/1997 | Green et al. |
| D383,037 | S | 9/1997 | Asberg |
| 5,803,290 | A | 9/1998 | Bongiorno |

(Continued)

OTHER PUBLICATIONS

Ultra Running Community "Inov-8 Race Ultra 0.25 Soft Flask Handheld" review; http://ultrarunningcommunity.com/reviews/full-gear-list/9-bag-review/653-inov-8-race-ultra-0-25-soft-flask-handheld; available prior to the filing date of the present application; accessed May 6, 2016.

(Continued)

*Primary Examiner* — Corey N Skurdal
(74) *Attorney, Agent, or Firm* — Faegre Drinker Biddle & Reath LLP

(57) ABSTRACT

A hydration bladder includes a flexible body. A port is coupled to the flexible body. A chamber is formed by the flexible body, and the chamber is configured to carry a liquid therein and is in communication with the port. The chamber has an hourglass-like shape that tapers inwardly and outwardly. A baffle is coupled to the flexible body within the chamber.

20 Claims, 7 Drawing Sheets

(56) References Cited

U.S. PATENT DOCUMENTS

| | | | | |
|---|---|---|---|---|
| D427,909 | S | 7/2000 | Doritty et al. | |
| D474,341 | S | 5/2003 | Cantone et al. | |
| D482,284 | S | 11/2003 | Cantone et al. | |
| 7,178,687 | B1 | 2/2007 | Manderfield, Jr. et al. | |
| D538,657 | S | 3/2007 | Webb et al. | |
| 7,490,740 | B2 * | 2/2009 | Robins | A45F 3/20 222/175 |
| 7,686,178 | B2 | 3/2010 | Grant et al. | |
| 8,020,730 | B2 * | 9/2011 | Liang | A45F 3/20 222/175 |
| 8,043,005 | B2 | 10/2011 | Lyon | |
| D662,419 | S | 6/2012 | Potts | |
| D676,336 | S * | 2/2013 | Murray | D9/707 |
| 2006/0027611 | A1 | 2/2006 | Hobbs | |
| 2010/0040307 | A1 * | 2/2010 | Lien | B65D 33/246 383/12 |
| 2011/0113524 | A1 * | 5/2011 | Sinder | A45F 3/20 2/93 |
| 2011/0132932 | A1 * | 6/2011 | Duran | A45F 3/20 222/175 |
| 2013/0075393 | A1 | 3/2013 | Haynie | |
| 2014/0374413 | A1 | 12/2014 | Lyon et al. | |
| 2014/0376833 | A1 | 12/2014 | Lyon et al. | |
| 2015/0053718 | A1 | 2/2015 | Lyon et al. | |
| 2015/0102058 | A1 | 4/2015 | Lyon et al. | |
| 2015/0284144 | A1 * | 10/2015 | Dytchkowskyj | B65D 75/5877 383/6 |
| 2017/0086568 | A1 * | 3/2017 | Ehyai | A45F 3/04 |

OTHER PUBLICATIONS

IRunFar.com "Hydrapak SoftFlask Review"; http://www.irunfar.com/2014/02/hydrapak-softflask-review.html; published Feb. 6, 2014; accessed May 6, 2016.

* cited by examiner

HYDRATION BLADDER INCLUDING LIQUID MOVEMENT REDUCING FEATURES

CROSS-REFERENCE TO RELATED APPLICATION

This application is a continuation of International Application No. PCT/US2016/035784, with an international filing date of Jun. 3, 2016, which is incorporated by reference herein in its entirety.

TECHNICAL FIELD

The present disclosure relates to hydration bladders for user-borne packs. More specifically, the present disclosure relates to hydration bladders including one or more features that reduce liquid movement while performing vigorous activities.

BACKGROUND

Some hydration bladders are carried by user-borne packs to provide users with liquids (for example, water) during various types of activities, such as running, hiking, and the like. Such user-borne packs are viewed favorably for various reasons. For example, such user-borne packs are typically lightweight and have unobtrusive sizes and profiles. However, liquids carried by such user-borne packs and hydration bladders can subjected to significant movement when users perform vigorous activities, such as running. This liquid movement is uncomfortable and/or distracting for some users.

SUMMARY

In a first example, a hydration bladder according to the present disclosure includes a flexible body; a port coupled to the flexible body; a chamber formed by the flexible body, the chamber configured to carry a liquid therein and in communication with the port, and the chamber having an hourglass-like shape tapering inwardly and outwardly; and a baffle coupled to the flexible body within the chamber.

In a second example, the baffle of the first example comprises a flexible sheet.

In a third example, the chamber of any of the preceding examples includes an intermediate portion tapering inwardly and outwardly to provide the hourglass-like shape of the chamber, the baffle being disposed in the intermediate portion.

In a fourth example, the intermediate portion of any of the preceding examples tapers to a minimum chamber width, the baffle being disposed at the minimum chamber width.

In a fifth example, the baffle of any of the preceding examples comprises: a central hub disposed at the minimum chamber width; and four legs extending outwardly from the central hub and coupled to the flexible body.

In a sixth example, the flexible body of any of the preceding examples comprises: a first flexible sheet; and a second flexible sheet coupled to the first flexible sheet and forming the chamber together with the first flexible sheet; wherein the baffle is coupled to both the first flexible sheet and the second flexible sheet.

In a seventh example, the baffle of any of the preceding examples comprises a central hub and four legs extending outwardly from the central hub, wherein two of the four legs are coupled to the first flexible sheet, and the other two of the four legs are coupled to the second flexible sheet.

In an eighth example, the port of any of the preceding examples is an inlet port, and the hydration bladder further comprises an outlet port coupled to the flexible body, and the hourglass-like shape of the chamber tapers inwardly and outwardly between the inlet port and the outlet port.

In a ninth example, a hydration bladder according to the present disclosure includes a flexible body; an inlet port coupled to the flexible body; an outlet port coupled to the flexible body; a chamber formed by the flexible body, the chamber configured to carry a liquid therein and in communication with the inlet port and the outlet port, and the chamber comprising: a first portion in communication with the inlet port; a second portion in communication with the first portion, the second portion and the first portion sharing a first chamber width, the second portion having a second chamber width, the second chamber width being less than the first chamber width; a third portion in communication with the outlet port, the third portion in communication with the second portion, the third portion and the second portion sharing a third chamber width, the third chamber width being disposed on an opposite side of the second chamber width than the first chamber width, and the third chamber width being greater than the second chamber width; and a baffle coupled to the flexible body within the chamber.

In a tenth example, the baffle of the ninth example comprises a flexible sheet.

In an eleventh example, the baffle of any of the preceding examples is disposed in the second portion of the chamber.

In a twelfth example, the baffle of any of the preceding examples is disposed at the second chamber width.

In a thirteenth example, the baffle of any of the preceding examples comprises: a central hub disposed at the second chamber width; and four legs extending outwardly from the central hub and coupled to the flexible body.

In a fourteenth example, the first chamber width of any of the preceding examples is less than the third chamber width.

In a fifteenth example, the flexible body of any of the preceding examples comprises: a first flexible sheet; and a second flexible sheet coupled to the first flexible sheet and forming the chamber together with the first flexible sheet; wherein the baffle is coupled to both the first flexible sheet and the second flexible sheet.

In a sixteenth example, the baffle of any of the preceding examples comprises a central hub and four legs extending outwardly from the central hub, wherein two of the four legs are coupled to the first flexible sheet, and the other two of the four legs are coupled to the second flexible sheet.

In a seventeenth example, a hydration bladder according to the present disclosure includes a flexible body; an inlet port coupled to the flexible body; an outlet port coupled to the flexible body; a chamber formed by the flexible body, the chamber configured to carry a liquid therein and in communication with the inlet port and the outlet port, and the chamber having an hourglass-like shape tapering inwardly and outwardly between the inlet port and the outlet port.

In an eighteenth example, the chamber of the seventeenth example includes a first chamber width and a second chamber width that form the hourglass-like shape, and the second chamber is from 61 percent to 71 percent of the first chamber width.

In a nineteenth example, the chamber of any of the preceding examples further includes a third chamber width that forms the hourglass-like shape, and the second chamber width is from 55 percent to 65 percent of the third chamber width.

In a twentieth example, the flexible body of any of the preceding examples comprises a first flexible sheet and a second flexible sheet coupled to the first flexible sheet.

As used herein, a "height" dimension generally corresponds to the long dimension of the hydration bladder or the superior-inferior dimension of the hydration bladder as worn on the back of a user. The "width" dimension generally corresponds to the wide dimension of the hydration bladder or the medial-lateral dimension of the hydration bladder as worn on the back of a user. As used herein, a "thickness" dimension or direction is perpendicular to both a height dimension or direction and a width dimension or direction.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

Figure 1:
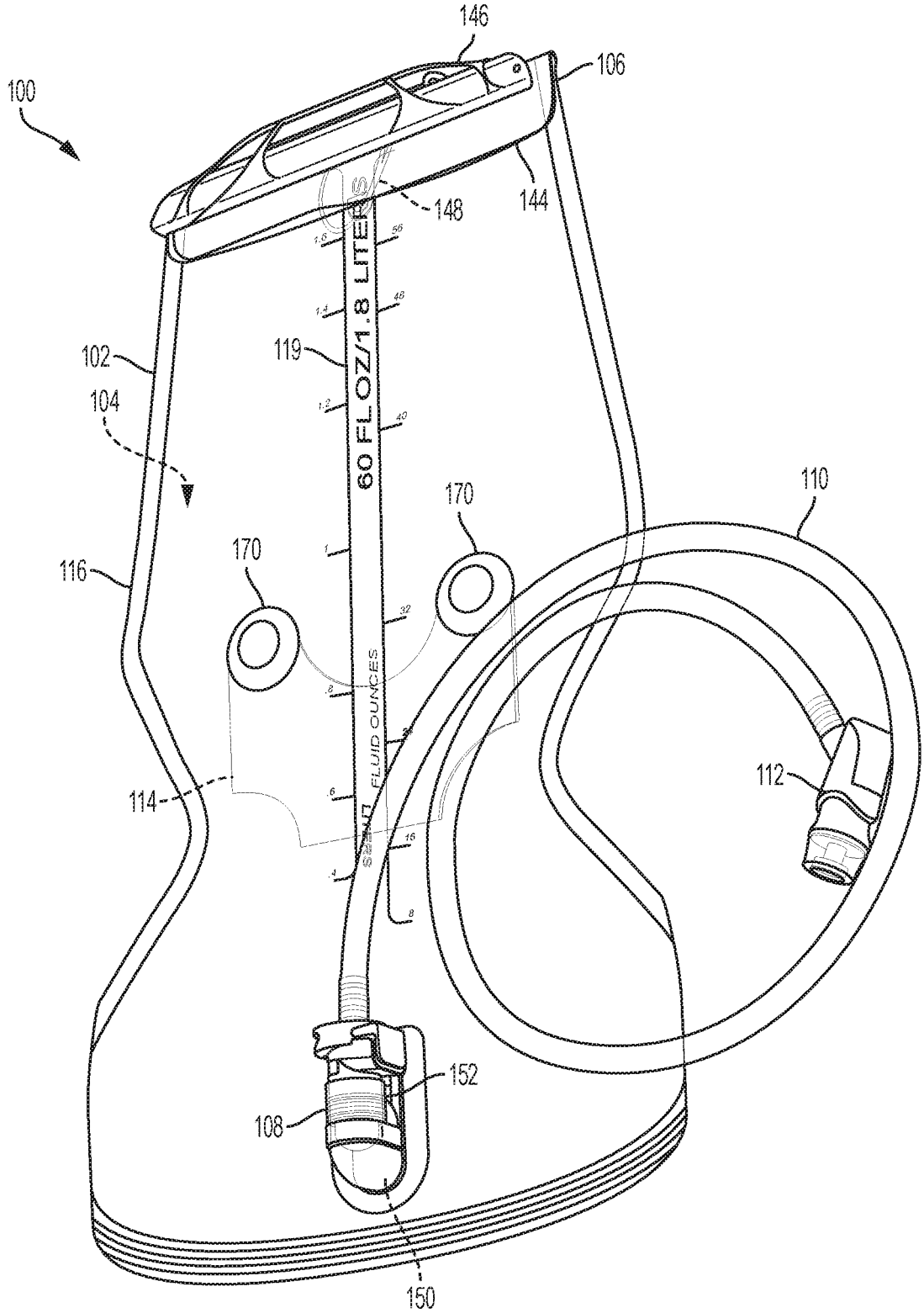
FIG. 1 is a perspective view of a hydration bladder coupled to a drinking hose according to some embodiments of the present disclosure.
Figure 2:
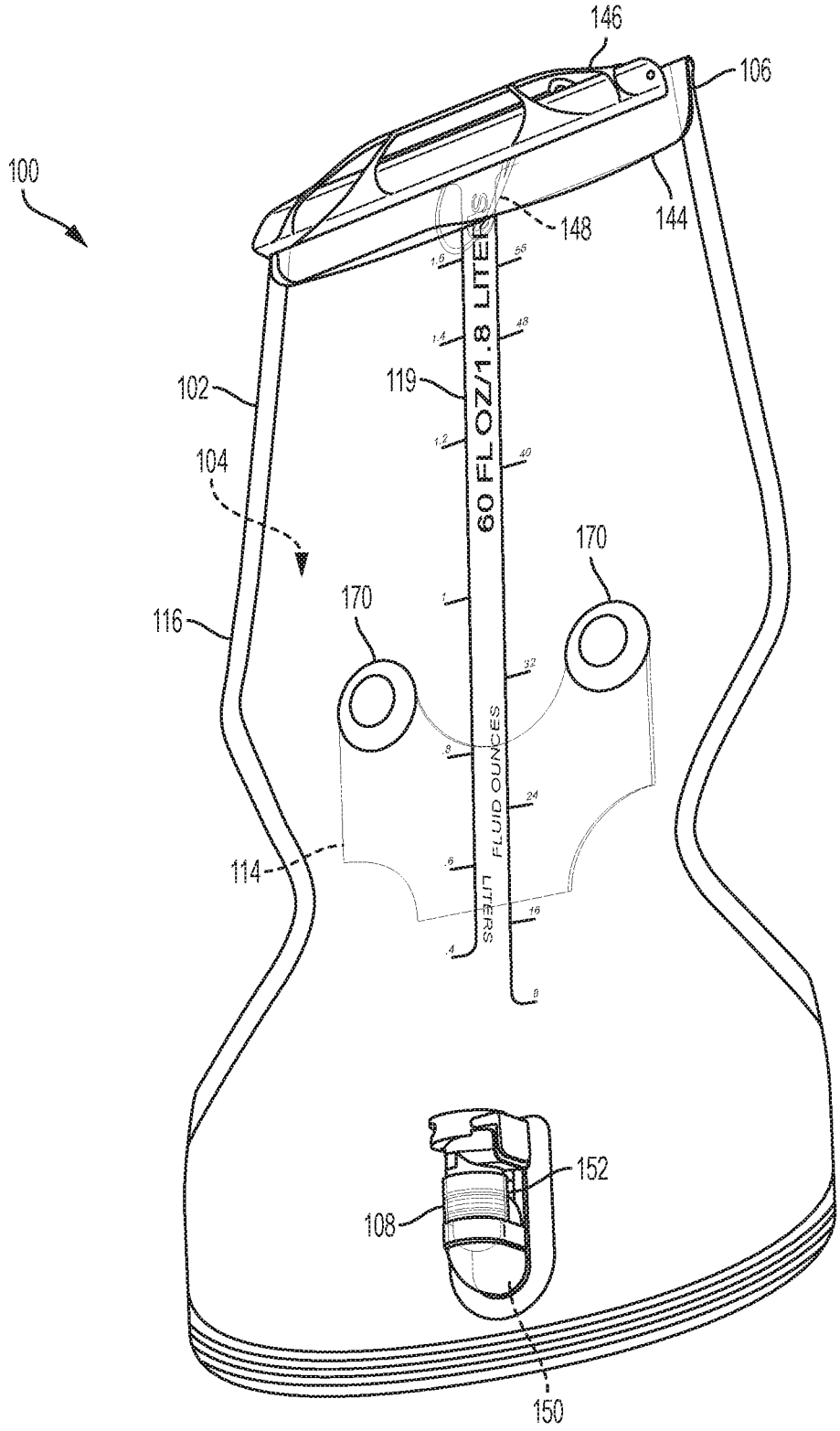
FIG. 2 is a perspective view of the hydration bladder of FIG. 1.
Figure 3:
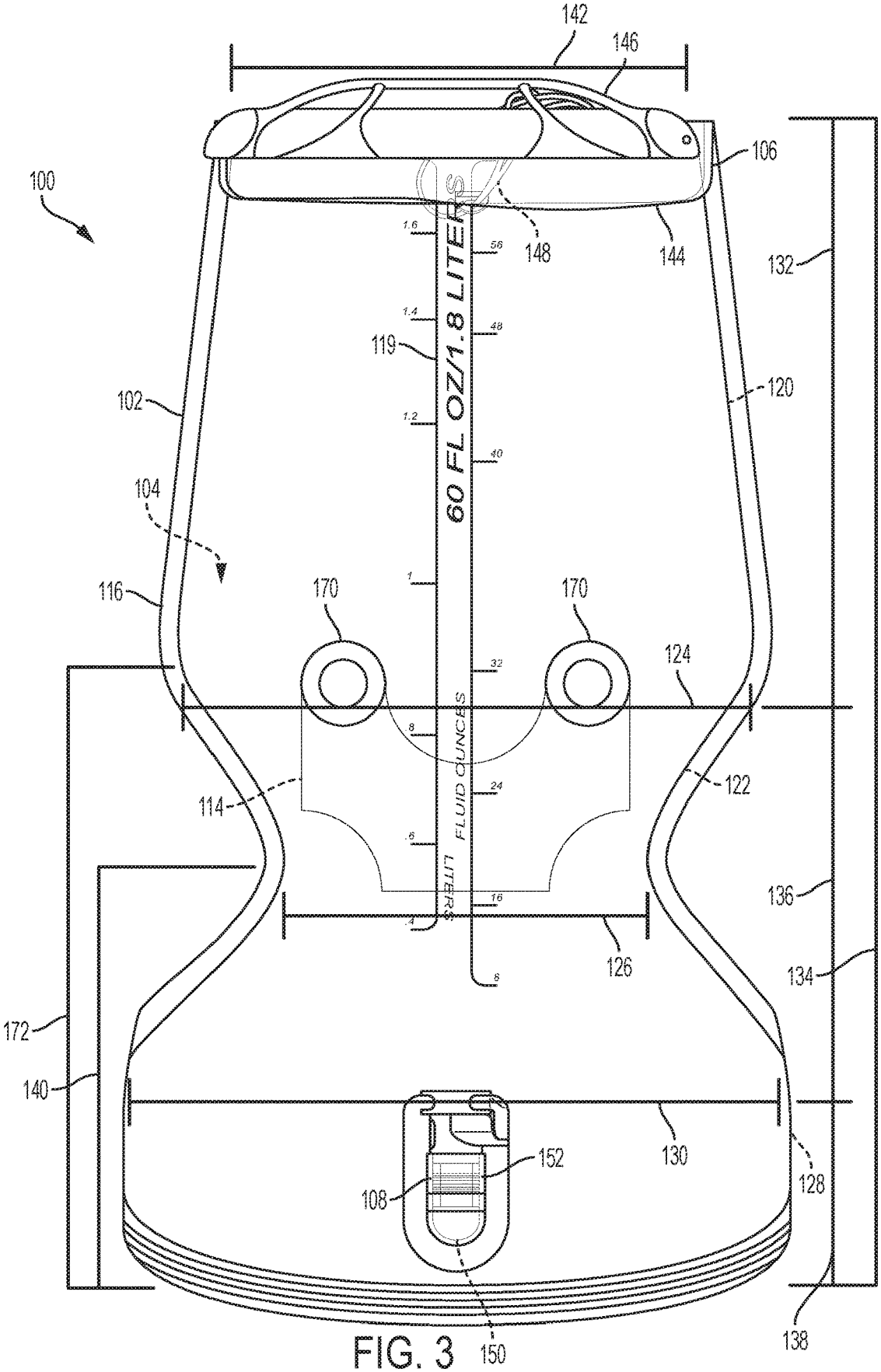
FIG. 3 is a front view of the hydration bladder of FIG. 1.
Figure 4:
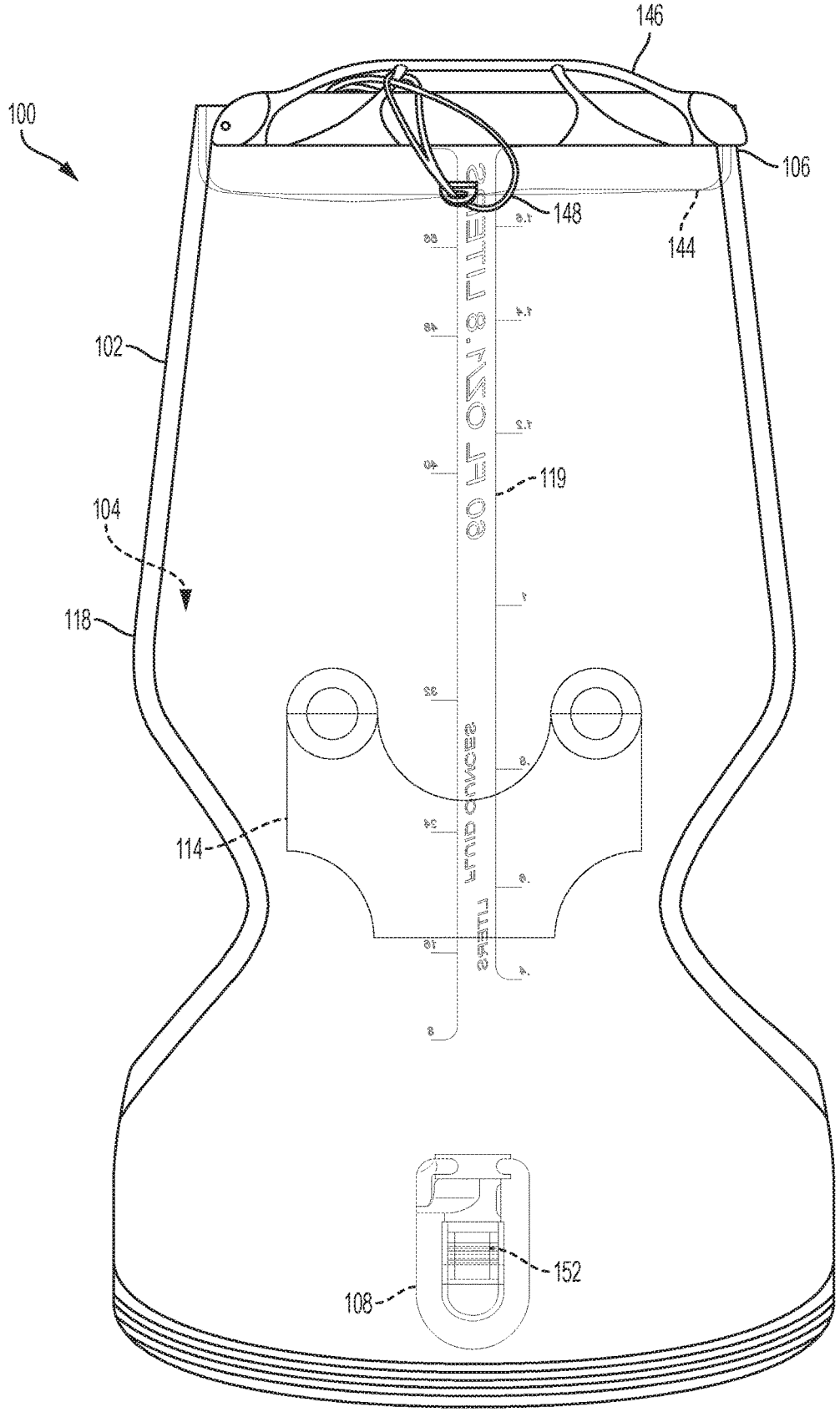
FIG. 4 is a back view of the hydration bladder of FIG. 1.
Figure 5:
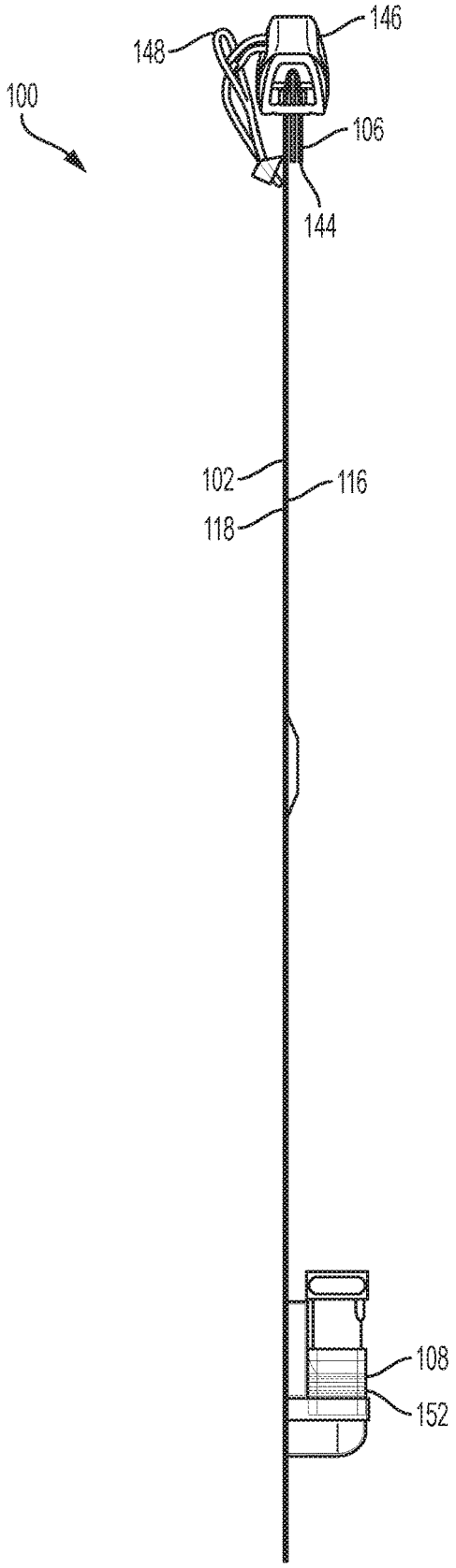
FIG. 5 is a left side view of the hydration bladder of FIG. 1.
Figure 6:
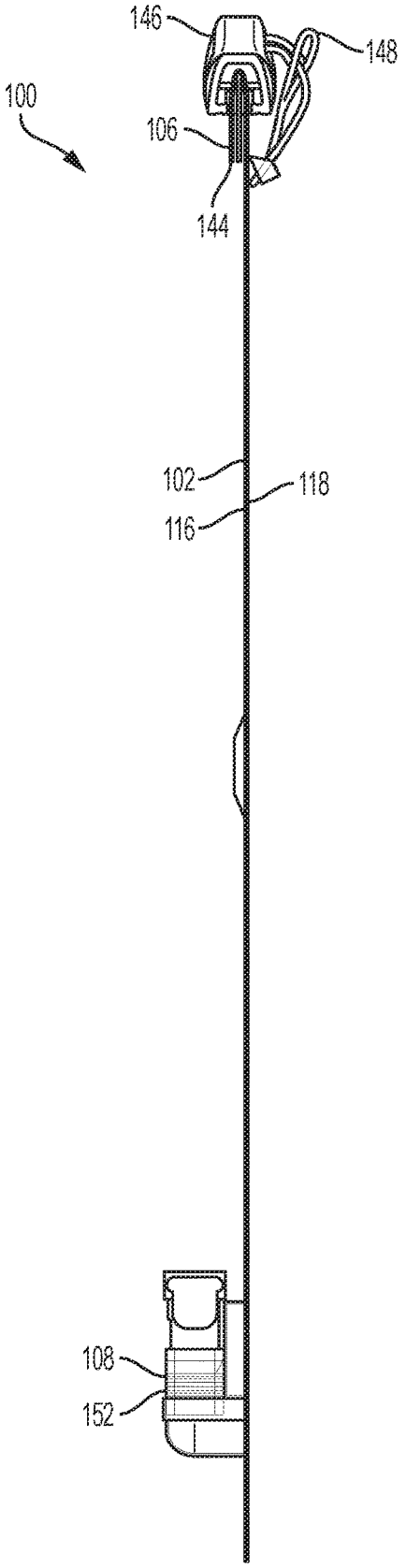
FIG. 6 is a right side view of the hydration bladder of FIG. 1.
Figure 7:
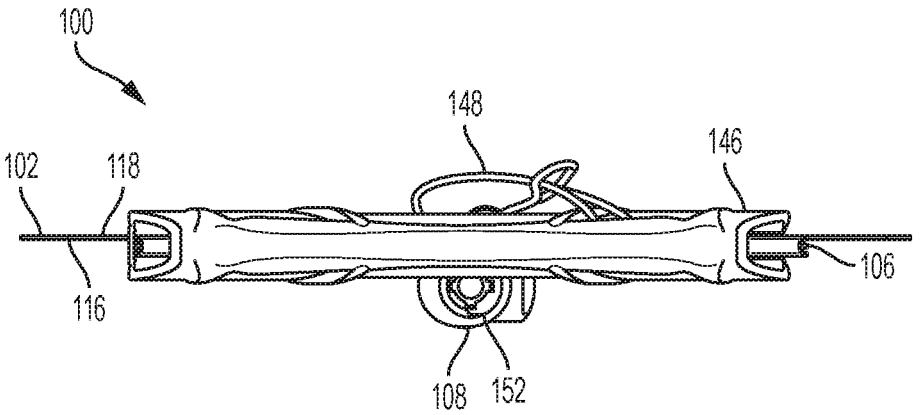
FIG. 7 is a top view of the hydration bladder of FIG. 1.
Figure 8:
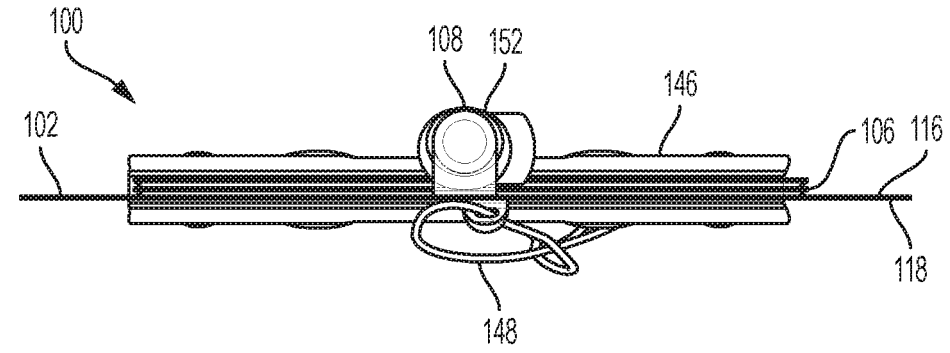
FIG. 8 is a bottom view of the hydration bladder of FIG. 1.

It should be understood that the drawings are intended facilitate understanding of exemplary embodiments of the present disclosure are not necessarily to scale.

DETAILED DESCRIPTION

FIGS. 1-8 illustrate a hydration bladder 100 according to some embodiments of the present disclosure. Generally, the hydration bladder 100 includes a flexible body 102 that forms an internal chamber 104. The chamber 104 receives and carries a liquid therein (for example, water). The flexible body 102 is coupled to an inlet port 106 and an outlet port 108, which are in communication with the chamber 104. The inlet port 106 and the outlet port 108 are in communication with the chamber 104 to deliver the liquid to and receive the liquid from, respectively, the chamber 104. The outlet port 108 detachably couples to a flexible drinking hose 110, which communicates with the outlet port 108 to receive the liquid therefrom. The drinking hose 110 carries a mouthpiece 112 that delivers water from the drinking hose 110 to a user.

The hydration bladder 100 also includes features that reduce liquid movement within the chamber 104 while a user performs vigorous activities, such as running and the like. Generally, these features include an hourglass-like shape of the chamber 104 and a baffle 114 carried within the chamber 104. The above and additional aspects of the hydration bladder 100 are described in further detail below.

In some embodiments, the flexible body 102 is formed of one or more flexible sheets or layers 116, 118. For example and as shown in the figures, the flexible body 102 may be formed of two flexible sheets 116, 118 that are coupled to each other along several edges (for example, via adhesive bonding, heat bonding, or the like). The flexible sheets 116, 118 may be formed of various materials, such as one or more polymers (for example, thermoplastic polyurethane (TPU), thermoplastic elastomers (TPE), polyethylene-vinyl acetate (PEVA), or polyethylene terephthalate (PET)). In some embodiments and as shown in the figures, the flexible sheets 116, 118 are formed of a translucent material. The flexible sheets 116, 118 may have thicknesses of about 0.25 mm to 0.5 mm.

In some embodiments, one of the flexible sheets 116, 118 includes a fill gauge 119 to indicate the amount of liquid carried in the chamber 104. The fill gauge 119 may include text, numbers, and other indicia.

The chamber 104 may be sized to provide any of various volume capacities. For example, the chamber 104 may have a volume capacity of 1 liter, 1.5 liters, 1.8 liters, 2 liters, 2.5 liters, 3 liters, or the like. In some embodiments, the chamber 104 is generally collapsible and configured to reduce in thickness as fluid is removed from the chamber 104. In others, the chamber 104 is configured to maintain its thickness regardless of the amount of liquid it carries.

As described briefly above, the chamber 104 has an hourglass-like shape to reduce liquid movement while the user performs vigorous activities. That is, the chamber 104 tapers inwardly and outwardly between the inlet port 106 and the outlet port 108, and the reduced width of the chamber 104 reduces liquid movement while the user performs vigorous activities. Stated another way and referring specifically to FIG. 3, the chamber 104 may have features and dimensions as follows. The chamber 104 includes a first portion 120, or "upper" portion, that is in communication with the inlet port 106. The first portion 120 is in communication with a second portion 122, or "intermediate" portion. The first portion 120 and the second portion 122 share a first chamber width 124. The second portion 122 also has a second chamber width 126 that is less than the first chamber width 124. In some embodiments, the second chamber width 126 is the minimum chamber width. The second portion 122 is in communication with a third portion 128, or "lower" portion, and the third portion 128 is in communication with the outlet port 108. The third portion 128 and the second portion 122 share a third chamber width 130, and the third chamber width 130 is disposed on an opposite side of the second chamber width 126 than the first chamber width 124. The third chamber width 130 is greater than the second chamber width 126. In some embodiments, the third chamber width 130 is greater than first chamber width 124.

The first chamber width 124, second chamber width 126, and the third chamber width 130 may be of various sizes. For example, the second chamber width 126 may be from 51 percent to 81 percent of the first chamber width 124, from 56 percent to 76 percent of the first chamber width 124, or from 61 percent to 71 percent of the first chamber width 124. As another example, the second chamber width 126 may be from 45 percent to 75 percent of the third chamber width 130, from 50 percent to 70 percent of the third chamber width 130, or from 55 percent to 65 percent of the third chamber width 130. As specific examples, the first chamber width 124 may be about 18 cm (that is, 18 cm±2 cm), the second chamber width 126 may be about 12 cm (that is, 12 cm±2 cm), and the third chamber width 130 may be about 20 cm (that is, 20 cm±2 cm).

The first portion 120, the second portion 122, and the third portion 128 may have various other dimensions. For example, the first portion 120 may have a height 132 that is from 29 percent to 59 percent of an overall height 134 of the chamber 104 (that is, a dimension between far ends of the first portion 120 and the third portion 128), from 34 percent to 54 percent of the overall height 134 of the chamber 104, or from 39 percent to 49 percent of the overall height 134 of the chamber 104. As another example, the second portion 122 may have a height 136 that is from 24 percent to 54 percent of the overall height 134 of the chamber 104, from 29 percent to 49 percent of the overall height 134 of the chamber 104, or from 34 percent to 44 percent of the overall height 134 of the chamber 104. As yet another example, the third portion 128 may have a height 138 that is from 2 percent to 32 percent of the overall height 134 of the chamber 104, from 7 percent to 27 percent of the overall height 134 of the chamber 104, or from 12 percent to 22 percent of the overall height 134 of the chamber 104. As a specific example, the first portion 120, the second portion 122, and the third portion 128 may provide an overall height 134 of about 36 cm (that is, 36 cm±2 cm). As another example, the second chamber width 126 may be disposed about halfway (that is, halfway ±5 percent) between the first chamber width 124 and the third chamber width 130. As another specific example, the chamber 104 may have a height 140 between the far end of the third portion 128 and the second chamber width 126 of about 14 cm (that is, 14 cm±2 cm). In some embodiments, the first portion 120 may have a far end width 142 that is less than the first chamber width 124. As a specific example, the far end width 142 may be about 15 cm (that is, 15 cm±2 cm). In some embodiments, the first portion 120 may taper outwardly from the far end width 142 to the first chamber width 124.

The inlet port 106, during typical use, is disposed above the flexible body 102. The inlet port 106 includes an opening 144 in communication with the chamber 104. The opening 144 may take various forms. In some embodiments and as shown in the figures, the opening 144 may be formed between uncoupled edges of the flexible sheets 116, 118. In these embodiments, the inlet port 106 could take the form of the closure system described in U.S. Pat. No. 8,186,881, the disclosure of which is hereby incorporated in its entirety. That is, generally, the inlet port 106 may further include a slider 146 that translatably couples to the flexible body 102 and closes the opening 144. The slider 146 may be coupled to the flexible body 102 via a tether 148. As another example, in some embodiments the opening 144 may be formed by only one of the flexible sheets 116, 118 of the body 102. In some embodiments, the opening 144 may be adjacent to and in communication with a threaded inlet coupling (not shown) that detachably couples to a threaded cap (not shown).

The outlet port 108, during typical use, is disposed below the inlet port 106. The outlet port 108 includes an opening 150 in communication with the chamber 104. The opening 150 may take various forms. In some embodiments and as shown in the figures, the opening 150 may be formed by one of the flexible sheets 116, 118. As another example, in some embodiments the opening 150 may be formed between uncoupled edges of the flexible sheets 116, 118. The opening 150 is adjacent to and in communication with a hose coupling 152. The hose coupling 152 detachably couples to the drinking hose 110 to facilitate communication therewith. The hose coupling 152 may take various forms. For example, in some embodiments and as shown in the figures, the hose coupling 152 may be a "quick release" coupling. In some embodiments, the hose coupling 152 may be a threaded coupling.

Figure 9:
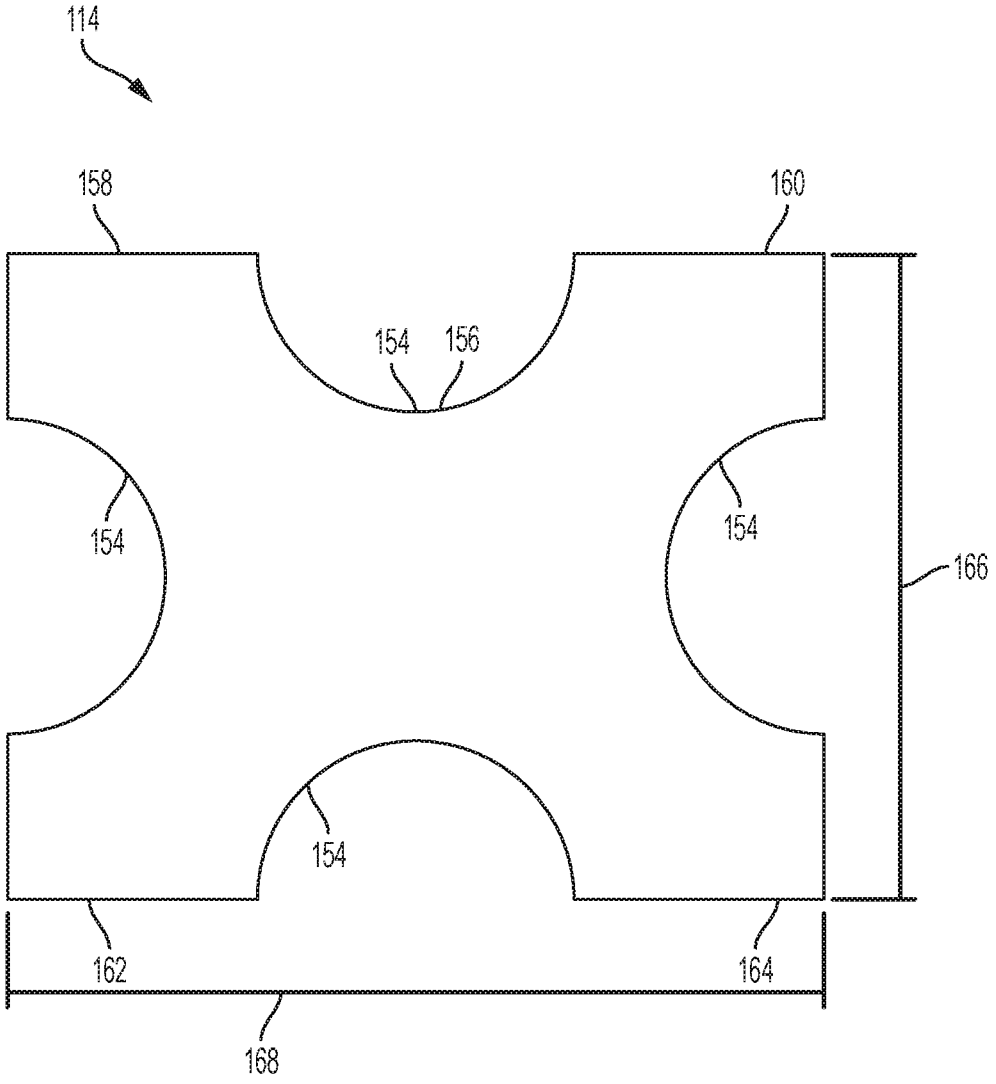
FIG. 9 is a top view of a baffle of the hydration bladder of FIG. 1 in an unfolded configuration.

The baffle 114, which may also be referred to as a "dam", is illustrated separately and in an unfolded configuration in FIG. 9. In some embodiments, the baffle 114 is formed of a flexible sheet. The baffle 114 may be formed of various materials, such as one or more polymers (for example, TPU, TPE, PEVA, PET, or polypropylene (PP)). In some embodiments and as shown in the figures, the baffle 114 is formed of a translucent material. The baffle 114 may have a thickness of about 0.25 mm to 0.5 mm. In some embodiments, the baffle 114 has a rectangular shape with semi-circular voids 154 along each of the sides. As a specific example, the semi-circular voids 154 are located at the midpoint of each of the sides. Stated another way, the voids 154 provide the baffle 114 with a central hub 156 and four legs 158, 160, 162, and 164 that extend outwardly from the central hub 156 toward the corners of the rectangular shape. The baffle 114 may have various dimensions. For example, the baffle 114 may have a width 166 from 73 percent to 93 percent of the second chamber width 126, or from 78 percent to 88 percent of the second chamber width 126. As another example, the baffle 114 may have an unfolded height 168 from 29 percent to 49 percent of the overall height 134 of the chamber 104, or from 34 percent to 44 percent of the overall height 134 of the chamber 104. As yet another, the semi-circular voids 154 may have radii from 46 percent to 66 percent of the width 166 of the baffle 114, or from 51 percent to 61 percent of the width 166 of the baffle 114. As a specific example, the width 166 of the baffle 114 may be about 10 cm (that is, 10 cm±2 cm) and the unfolded height 168 may be about 14 cm (that is, 14 cm±2 cm).

The baffle 114 may have various other shapes and/or dimensions than those 110 described above. For example, in some embodiments the baffle 114 may have a rectangular shape with triangular-shaped voids (not shown) along the sides to provide the baffle 114 with an "X" shape.

In some embodiments, the baffle 114 is coupled to one or both of the flexible sheets 116, 118. In some embodiments and as shown in the figures, the baffle 114 is coupled to both of the flexible sheets 116, 118. Specifically, the first leg 158 and the third leg 162 are detachably coupled to the first flexible sheet 116 (for example, by pins or posts 170 carried by the first flexible sheet; see FIGS. 1-3), and the second leg 160 and the fourth leg 164 are coupled to the second flexible sheet 118 (for example, via adhesive bonding, heat bonding, or the like). In some embodiments, the baffle 114 is disposed within the second portion 122 of the chamber 104. In some embodiments, the legs 158, 160, 162, and 164 couple to the flexible sheets 116, 118 at a common height 172 from the far end of the third portion 128 of the chamber 104 (see FIG. 3), and the central hub 156 is disposed closer to the third portion 128 than the legs 158, 160, 162, and 164. The common height 172 may be, for example, from 29 percent to 49 percent of the overall height 134 of the chamber 104, or from 34 percent to 44 percent of the overall height 134 of the chamber 104. As a specific example, the common height 172 may be about 20 cm (that is, 20 cm±2 cm). In some embodiments, the central hub 156 is disposed at the second chamber width 126, or the second chamber width 126 intersects with the central hub 156.

The hydration bladder 100 may be modified in various other manners. For example, in some embodiments the hydration bladder 100 may include a single port that facilitates delivering a liquid to and receiving the liquid from the chamber 104. As a specific example, the hydration bladder 100 may include the outlet port 108 but lack the inlet port 106 described above.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

The following is claimed:

1. A hydration bladder comprising:

a flexible body comprising a first flexible sheet and a second flexible sheet coupled to the first flexible sheet;

a port coupled to the flexible body;

a chamber formed by the flexible body, the chamber configured to carry a liquid therein and in communication with the port, and the chamber having an intermediate portion tapering inwardly and outwardly to provide an hourglass-like shape and tapering to a minimum chamber width;

a baffle coupled to the flexible body within the chamber and disposed in the intermediate portion, the baffle comprising:

a first side portion coupled to the first flexible sheet and disposed on a first side of the minimum chamber width;

a second side portion coupled to the second flexible sheet and disposed on the first side of the minimum chamber width; and an intermediate baffle portion disposed between the first side portion and the second side portion, the intermediate baffle portion disposed on a second side of the minimum chamber width.

2. The hydration bladder of claim 1, wherein the baffle comprises a flexible sheet.

3. The hydration bladder of claim 1, wherein the port is an inlet port, further comprising an outlet port coupled to the flexible body, and wherein the hourglass-like shape of the chamber tapers inwardly and outwardly between the inlet port and the outlet port.

4. The hydration bladder of claim 1, wherein the baffle is detachably coupled to the first flexible sheet and coupled to the second flexible sheet.

5. The hydration bladder of claim 4, wherein the baffle couples to the second flexible sheet via one of adhesive bonding and heat bonding.

6. The hydration bladder of claim 4, wherein the baffle detachably couples to the first flexible sheet via posts carried by the first flexible sheet.

7. The hydration bladder of claim 1, whereupon in an unfilled configuration of the hydration bladder the baffle occupying a folded configuration and being disposed in the intermediate portion.

8. A hydration bladder comprising:

a flexible body;

an inlet port coupled to the flexible body;

an outlet port coupled to the flexible body;

a chamber formed by the flexible body, the chamber configured to carry a liquid therein and in communication with the inlet port and the outlet port, and the chamber comprising:

a first portion in communication with the inlet port;

a second portion in communication with the first portion, the second portion and the first portion sharing a first chamber width, the second portion having a second chamber width, the second chamber width being less than the first chamber width;

a third portion in communication with the outlet port, the third portion in communication with the second portion, the third portion and the second portion sharing a third chamber width, the third chamber width being disposed on an opposite side of the second chamber width than the first chamber width, and the third chamber width being greater than the second chamber width; and a baffle coupled to the flexible body within the chamber and disposed in the second portion of the chamber, in an unfilled configuration of the hydration bladder the baffle occupying a folded configuration and being intersected by the second chamber width.

9. The hydration bladder of claim 8, wherein the baffle comprises a flexible sheet.

10. The hydration bladder of claim 8, wherein the first chamber width is less than the third chamber width.

11. The hydration bladder of claim 8, wherein the flexible body comprises:

a first flexible sheet; and a second flexible sheet coupled to the first flexible sheet and forming the chamber together with the first flexible sheet;

wherein the baffle is coupled to both the first flexible sheet and the second flexible sheet.

12. The hydration bladder of claim 11, wherein the baffle is detachably coupled to the first flexible sheet.

13. The hydration bladder of claim 12, wherein the baffle couples to the second flexible sheet via one of adhesive bonding and heat bonding.

14. The hydration bladder of claim 12, wherein the baffle detachably couples to the first flexible sheet via posts carried by the first flexible sheet.

15. A hydration bladder comprising:

a flexible body comprising a first flexible sheet and a second flexible sheet coupled to the first flexible sheet;

an inlet port coupled to the flexible body;

an outlet port coupled to the flexible body;

a chamber formed by the flexible body, the chamber configured to carry a liquid therein and in communication with the inlet port and the outlet port; and a baffle disposed within the chamber, the baffle being detachably coupled to the first flexible sheet and coupled to the second flexible sheet.

16. The hydration bladder of claim 15, wherein the baffle couples to the second flexible sheet via one of adhesive bonding and heat bonding.

17. The hydration bladder of claim 15, wherein the baffle detachably couples to the first flexible sheet via posts carried by the first flexible sheet.

18. The hydration bladder of claim 15, wherein the chamber has an hourglass-like shape tapering inwardly and outwardly between the inlet port and the outlet port.

19. The hydration bladder of claim 18, wherein the chamber includes a first chamber width and a second chamber width that form the hourglass-like shape, and the second chamber is from 61 percent to 71 percent of the first chamber width.

20. The hydration bladder of claim 19, wherein the chamber further includes a third chamber width that forms the hourglass-like shape, and the second chamber width is from 55 percent to 65 percent of the third chamber width.

* * * * *